US008857395B2

(12) United States Patent
Mukaide et al.

(10) Patent No.: US 8,857,395 B2
(45) Date of Patent: Oct. 14, 2014

(54) VALVE TIMING CONTROL APPARATUS

(71) Applicant: Aisin Seiki Kabushiki Kaisha, Kariya (JP)

(72) Inventors: Hiroki Mukaide, Chiryu (JP); Shigemitsu Suzuki, Takahama (JP); Naoto Toma, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/946,396

(22) Filed: Jul. 19, 2013

(65) Prior Publication Data

US 2014/0076250 A1 Mar. 20, 2014

(30) Foreign Application Priority Data

Sep. 18, 2012 (JP) ..... 2012-204821

(51) Int. Cl.
*F01L 1/34* (2006.01)
*F01L 1/344* (2006.01)

(52) U.S. Cl.
CPC ..... *F01L 1/3442* (2013.01); *F01L 2001/34446* (2013.01); *F01L 2001/34423* (2013.01)
USPC ..... 123/90.17; 123/90.12; 123/90.13; 123/90.15; 464/160

(58) Field of Classification Search
USPC ..... 123/90.12, 90.13, 90.15, 90.17; 464/160
See application file for complete search history.

(56) References Cited

U.S. PATENT DOCUMENTS

| | | | | |
|---|---|---|---|---|
| 5,263,441 | A | 11/1993 | Rembold et al. | |
| 7,513,230 | B2 * | 4/2009 | Knecht et al. | 123/90.17 |
| 8,322,317 | B2 | 12/2012 | Suzuki et al. | |
| 2008/0283010 | A1 | 11/2008 | Bohner et al. | |
| 2012/0079998 | A1 | 4/2012 | Strauss et al. | |
| 2012/0145100 | A1 | 6/2012 | Meinig et al. | |
| 2013/0118428 | A1 | 5/2013 | Suzuki et al. | |

FOREIGN PATENT DOCUMENTS

| | | | |
|---|---|---|---|
| JP | 10-54215 | H | 2/1998 |
| JP | 11-13429 | A | 1/1999 |
| JP | 2010-196698 | A | 9/2010 |

OTHER PUBLICATIONS

Extended European Search Report dated Dec. 16, 2013, issued by the European Patent Office in corresponding European Patent Application No. 13181375.0-1603. (6 pages).

* cited by examiner

*Primary Examiner* — Ching Chang
(74) *Attorney, Agent, or Firm* — Buchanan Ingersoll & Rooney PC

(57) ABSTRACT

A valve timing control apparatus includes a driving-side rotation member, a driven-side rotation member, a fluid chamber, an advanced angle chamber and a retarded angle chamber, a fluid control valve portion controlling supply and discharge of fluid relative to each of the advanced angle chamber and the retarded angle chamber, an accumulator accumulating a portion of fluid supplied to the fluid control valve portion from a pump at a fluid storage portion during an operation of an internal combustion engine and supplying fluid accumulated at the fluid storage portion to the fluid control valve portion at a start of the internal combustion engine, and a supply flow passage connecting the pump, the fluid control valve portion, and the accumulator in series. The accumulator includes a relief control valve portion configured to maintain a pressure of fluid accumulated at the fluid storage portion equal to or smaller than a predetermined value.

5 Claims, 11 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2012-204821, filed on Sep. 18, 2012, the entire content of which is incorporated herein by reference.

TECHNICAL FIELD

This disclosure generally relates to a valve timing control apparatus for controlling a relative rotation phase of a driven-side rotation member relative to a driving-side rotation member rotating in synchronization with a crankshaft of an internal combustion engine.

BACKGROUND DISCUSSION

A valve timing control apparatus configured to change an opening and closing timing of each of an intake valve and an exhaust valve depending on an operation condition of an internal combustion engine (which will be hereinafter referred to as an engine) has been developed. Such valve timing control apparatus includes, for example, a configuration in which a relative rotation phase of a driven-side rotation member relative to a driving-side rotation member that rotates by an engine operation is changed so as to change the opening and closing timing of each of the intake valve and the exhaust valve opening and closing in association with the rotation of the driven-side rotation member.

A known valve timing control apparatus disclosed in, for example, JP2010-196698A, which will be hereinafter referred to as Reference 1, includes a fluid control valve portion for controlling supply and discharge of hydraulic oil serving as fluid relative to an advanced angle chamber or a retarded angle chamber, a lock mechanism for switching between a locked state in which the relative rotation of the driven-side rotation member relative to the driving-side rotation member is restricted and an unlocked state (a lock released state) in which the locked state of the relative rotation is released, and a lock valve portion for controlling supply and discharge of hydraulic oil relative to the lock mechanism.

According to the valve timing control apparatus, a pump driven by power of an engine is used to supply the hydraulic oil to the advanced angle chamber or the retarded angle chamber. Immediately after the engine is started, however, a prompt supply of hydraulic oil from the pump may be impossible and therefore the supply of hydraulic oil to the advanced angle chamber or the retarded angle chamber may be insufficient. In order to solve such issue, according to JP11-13429A, which will be hereinafter referred to as Reference 2, an accumulator is provided as an auxiliary oil pressure generation apparatus for supplying the hydraulic oil to the advanced angle chamber or the retarded angle chamber at the start of the engine.

The accumulator is configured to accumulate or store the hydraulic oil in a pressurized state. The accumulator is connected to a hydraulic passage via a check valve and an oil switching valve (a solenoid valve) which are arranged in parallel to each other. The check valve allows the hydraulic oil to flow into the accumulator and inhibits the hydraulic oil from flowing out from the accumulator. The oil switching valve allows the hydraulic oil to flow out from the accumulator. The oil switching valve is opened in a case where a predetermined electric current is supplied to the oil switching valve and is closed when the supply of electric current is stopped.

In order to release the hydraulic oil accumulated at the accumulator therefrom, the check valve may be directly opened by a solenoid in a configuration in which the oil switching valve is not provided. At this time, a pressure exceeding a pressure of hydraulic oil accumulated in the accumulator is applied by the solenoid to the check valve so as to securely open the check valve. Nevertheless, in a case where an unexpected oil pressure is applied to the accumulator because of pulsation, for example, and therefore the hydraulic oil is accumulated at high pressure in the accumulator, the pressure of hydraulic oil in the accumulator may exceed a pressure applied to the check valve by the solenoid. In such case, the check valve is impossible to open by the solenoid, which inhibits the hydraulic oil from being released from the accumulator.

A need thus exists for a valve timing control apparatus which is not susceptible to the drawback mentioned above.

SUMMARY

According to an aspect of this disclosure, a valve timing control apparatus includes a driving-side rotation member rotating in synchronization with a crankshaft of an internal combustion engine, a driven-side rotation member arranged coaxial with the driving-side rotation member and rotating in synchronization with a camshaft for opening and closing a valve of the internal combustion engine, a fluid chamber formed by the driving-side rotation member and the driven-side rotation member, an advanced angle chamber and a retarded angle chamber formed by divided portions of the fluid chamber divided by a partition portion that is provided at at least one of the driving-side rotation member and the driven-side rotation member, a fluid control valve portion controlling supply and discharge of fluid relative to each of the advanced angle chamber and the retarded angle chamber, an accumulator accumulating a portion of fluid supplied to the fluid control valve portion from a pump at a fluid storage portion during an operation of the internal combustion engine and supplying fluid accumulated at the fluid storage portion to the fluid control valve portion at a start of the internal combustion engine, and a supply flow passage connecting the pump, the fluid control valve portion, and the accumulator in series to cause fluid to flow therethrough. The accumulator includes a relief control valve portion that is configured to maintain a pressure of fluid accumulated at the fluid storage portion equal to or smaller than a predetermined value.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A valve timing control apparatus 1 according to a first embodiment will be explained with reference to FIGS. 1 to 6.

Figure 1:
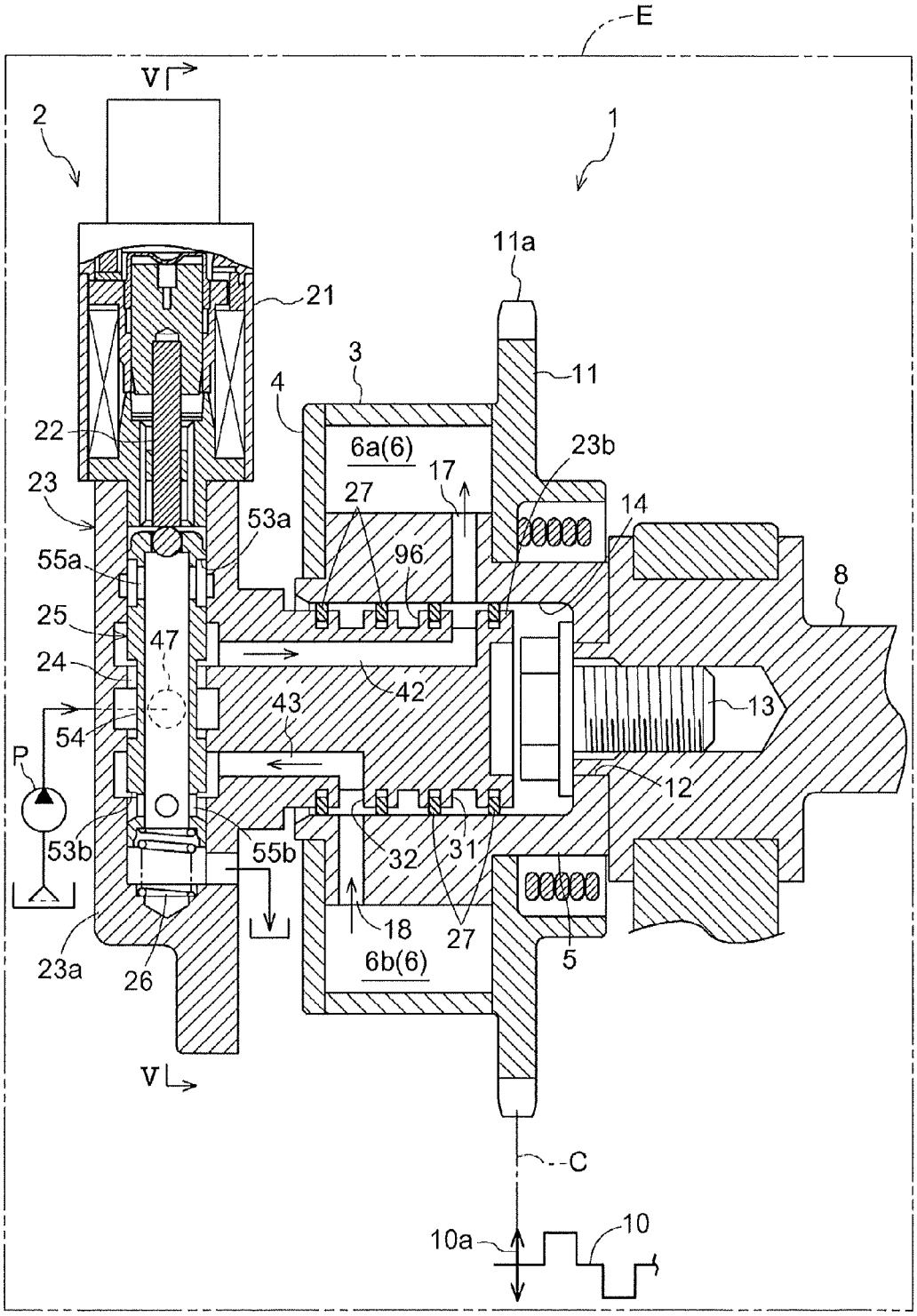
FIG. 1 is a longitudinal section view illustrating a configuration of a fluid control valve portion of a valve timing control apparatus according to a first embodiment disclosed here.
Figure 2:
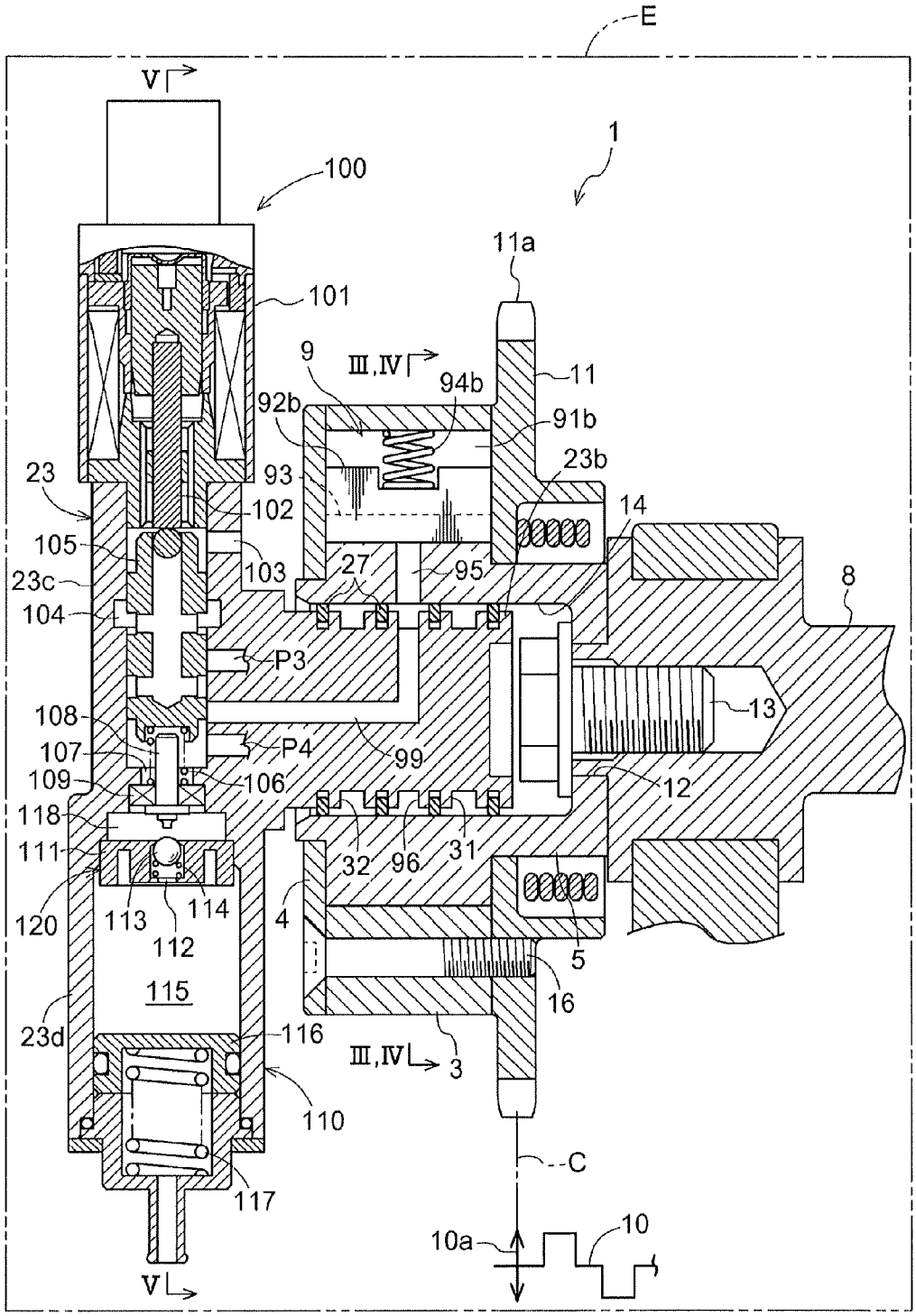
FIG. 2 is a longitudinal section view illustrating a configuration of a lock control valve portion of the valve timing control apparatus according to the first embodiment disclosed here.

As illustrated in FIGS. 1 and 2, the valve timing control apparatus 1 includes an outer rotor 3 serving as a driving-side rotation member and an inner rotor 5 serving as a driven-side rotation member. The outer rotor 3 rotates in synchronization with a crankshaft 10 of an engine E serving as an internal combustion engine. The inner rotor 5 is arranged coaxially with the outer rotor 3 to rotate in synchronization with a camshaft 8 for opening and closing valves of the engine E.

The inner rotor 5 is integrally assembled on an end portion of the camshaft 8 serving as a rotation shaft of a cam for controlling opening and closing of an intake valve or an exhaust valve of the engine E. The inner rotor 5 coaxially includes a recess portion 14 recessed from one side facing a front plate 4. A fixation hole 12 is formed at a bottom surface of the recess portion 14 to penetrate therethrough towards the camshaft 8. A protruding portion is formed at a portion of the camshaft 8 facing the inner rotor 5 so as to fit to the fixation hole 12. A thread groove is formed at the camshaft 8 in an axial direction from the protruding portion. In a state where the protruding portion and the fixation hole 12 is fitted, a bolt 13 is inserted from the recess portion 14 so that the inner rotor 5 and the camshaft 8 are tightened and fixed to each other. The camshaft 8 is rotatably assembled on a cylinder head.

As illustrated in FIG. 2, the outer rotor 3 is arranged coaxially with the inner rotor 5. The outer rotor 3 and the inner rotor 5 are integrally provided in a state to be sandwiched between the front plate 4 and a rear plate 11 and to be tightened by a bolt 16. The outer rotor 3 is rotatable relative to the inner rotor 5 within a predetermined range. A sprocket portion 11*a* is formed at an outer periphery of the rear plate 11. As illustrated in FIGS. 1 and 2, a timing chain C serving as an example of a power transmission member is wound between the sprocket portion 11*a* and an output sprocket 10*a* formed at the crankshaft 10.

In a case where the crankshaft 10 is rotatably driven, the rotation power thereof is transmitted from the output sprocket 10*a* to the sprocket portion 11 a via the timing chain C so that the outer rotor 3 is rotatably driven in synchronization with the crankshaft 10. Then, the inner rotor 5 is rotatably driven in association with the rotational driving of the outer rotor 3 to thereby rotate the camshaft 8. The cam provided at the camshaft 8 presses and opens the intake valve or the exhaust valve of the engine E.

Figure 3:
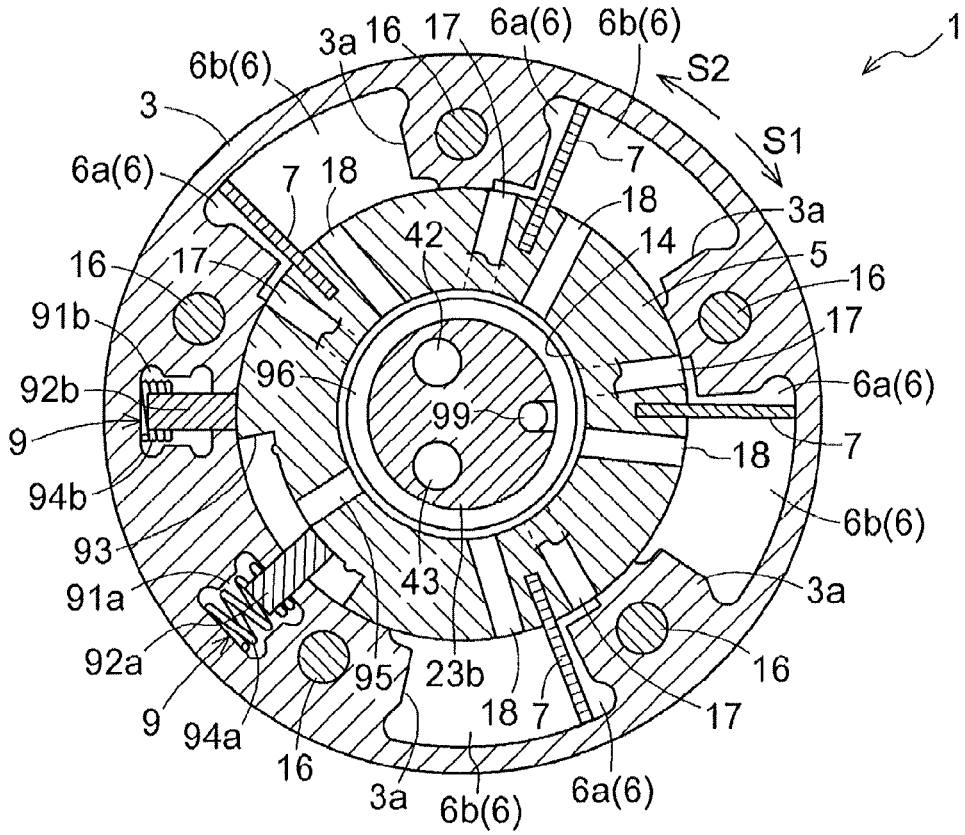
FIG. 3 is a cross-sectional view taken along line in FIG. 2.

As illustrated in FIG. 3, plural protruding portions are formed at the outer rotor 3 to radially inwardly protrude. The protruding portions are arranged at intervals along a rotating direction of the outer rotor 3. The adjacent protruding portions and the inner rotor 5 define fluid chambers 6. According to the present embodiment, four fluid chambers 6 are provided. The number of fluid chambers 6, however, is not limited to four and may be any numbers.

Figure 4:
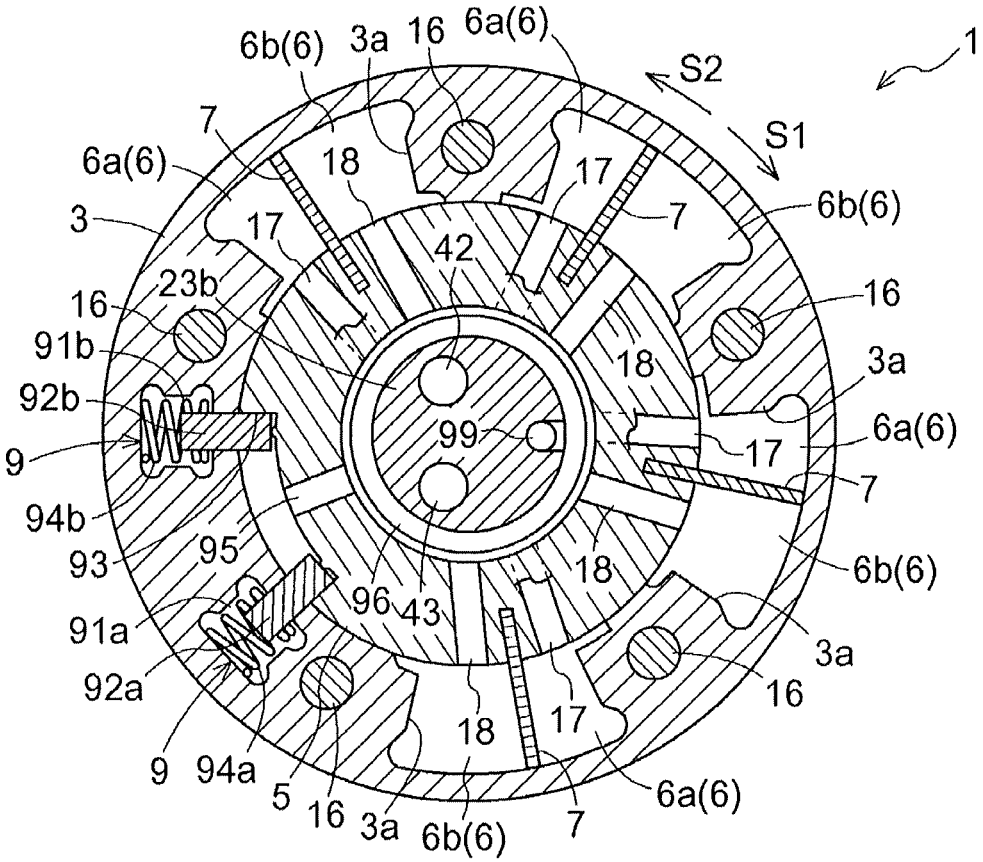
FIG. 4 is a cross-sectional view taken along line IV-IV in FIG. 2.

As illustrated in FIGS. 3 and 4, grooves are formed at an outer peripheral portion of the inner rotor 5 to face the respective fluid chambers 6. Vanes 7 each serving as a partition portion are inserted into the respective grooves. Each of the fluid chambers 6 is divided by the vane 7 to form an advanced angle chamber 6*a* in an advanced direction S1 in view of a relative rotation direction and a retarded angle chamber 6*b* in a retarded direction S2 in view of the relative rotation direction. The advanced angle direction S1 corresponds to a direction in which each of the vanes 7 is displaced, which is illustrated by an arrow S1 in FIGS. 3 and 4. The retarded angle direction S2 corresponds to a direction in which each of the vanes 7 is displaced, which is illustrated by an arrow S2 in FIGS. 3 and 4.

As illustrated in FIGS. 1, 3, and 4, an advanced angle chamber connection bore 17 and a retarded angle chamber connection bore 18 are formed at the inner rotor 5. The advanced angle chamber connection bore 17 connects between the recess portion 14 and the advanced angle chamber 6*a*. The retarded angle chamber connection bore 18 connects between the recess portion 14 and the retarded angle chamber 6*b*.

As illustrated in FIG. 1, hydraulic oil serving as fluid is supplied from a pump P to the advanced angle chambers 6*a* or the retarded angle chambers 6*b*, or is discharged from the advanced angle chambers 6*a* or the retarded angle chambers 6*b* to the pump P so as to displace a relative rotation phase of the inner rotor 5 relative to the outer rotor 3 (which will be hereinafter simply referred to as a "relative rotation phase") in the advanced angle direction S1 or the retarded angle direction S2.

In a case where the hydraulic oil is supplied to the advanced angle chambers 6*a*, the relative rotation phase is displaced in the advanced angle direction S1. In a case where the hydraulic oil is supplied to the retarded angle chambers 6*b*, the relative rotation phase is displaced in the retarded angle direction S2. A range where the relative rotation phase is displaceable corresponds to a range where each of the vanes 7 is displaceable in the fluid chamber 6. That is, the range is defined between a most retarded angle phase in which a volume of each of the retarded angle chambers 6*b* is maximum and a most advanced angle phase in which a volume of each of the advanced angle chambers 6*a* is maximum.

As illustrated in FIG. 1, a fluid control valve mechanism of the valve timing control apparatus 1 according to the present embodiment includes a fluid control valve portion 2. The supply and discharge of hydraulic oil relative to the advanced angle chambers 6*a* and the retarded angle chambers 6*b* are controlled by the fluid control valve portion 2. The fluid control valve mechanism is relatively rotatablly inserted into the recess portion 14 of the inner rotor 5 and is fixed to a static member, for example, to a front cover of the engine E. As a result, the fluid control valve mechanism is static and is inhibited from following the rotation of the inner rotor 5.

The fluid control valve portion 2 includes a solenoid 21, a rod 22, a housing 23, a spool 25, and a spring 26. The spool 25 is formed in cylindrical form including a bottom. The housing 23 includes a first spool accommodating portion 23*a* accommodating the spool 25 and a protruding portion 23*b* coaxially inserted into the recess portion 14. A hollow portion 24 is formed at the first spool accommodating portion 23*a* so as to coaxially accommodate the spool 25. The hollow portion 24 is in cylindrical form including a bottom and opening at one side. The protruding portion 23*b* is in column form corresponding to a form of the recess portion 14. The hollow portion 24 of the first spool accommodating portion 23*a* and the protruding portion 23*b* are formed so that axes of the hollow portion 24 and the protruding portion 23*b* are positioned perpendicular to each other. The spool 25 is lineally movable in an axial direction of the hollow portion 24.

As illustrated in FIG. 1, the fluid control valve portion 2 is configured so that the protruding portion 23*b* is relatively rotatably inserted into the recess portion 14 of the inner rotor 5 and the housing 23 is fitted to the front cover, for example, of the engine E. As a result, the inner rotor 5 is supported by the protruding portion 23*b* to be relatively rotatable thereto.

As illustrated in FIG. 1, the spring 26 is arranged between the spool 25 and a bottom surface of the hollow portion 24. The spool 25 is biased to an opening side of the hollow portion 24 by means of a biasing force of the spring 26. The solenoid 21 is arranged at an end portion of the first spool accommodating portion 23*a* at an opening side thereof. The solenoid 21 is selectively supplied with an electric power so as to reciprocate the spool 25. The rod 22 provided at an end portion of the solenoid 21 is in contact with a bottom portion of the spool 25. When the solenoid 21 is supplied with power, the rod 22 protrudes from the solenoid 21 to press the bottom portion of the spool 25 so that the spool 25 moves in a direction away from the solenoid 21, i.e., in a downward direction in FIG. 1. When the power supply to the solenoid 21 is stopped, the rod 22 is retracted towards the solenoid 21. The spool 25 moves in a direction towards the solenoid 21, i.e., in an upward direction in FIG. 1, so as to follow the movement of the rod 22 by the biasing force of the spring 26.

As illustrated in FIG. 1, four annular grooves are formed at an outer peripheral surface of the protruding portion 23*b* in parallel with one another over an entire periphery. Seal rings 27 for preventing leakage of hydraulic oil are attached to the grooves respectively. An outer peripheral groove for an advanced angle chamber 31, which will be hereinafter referred to as an advanced angle outer peripheral groove 31, an outer peripheral groove for a retarded angle chamber 32, which will be hereinafter referred to as a retarded angle outer peripheral groove 32, and an outer peripheral groove for locking 96, which will be hereinafter referred to as a lock outer peripheral groove 96, are formed between adjacent grooves respectively. Each of the advanced angle outer peripheral groove 31, the retarded angle outer peripheral groove 32, and the lock outer peripheral groove 96 includes an annular form. Because of the seal rings 27, the hydraulic oil is inhibited from leaking from any of the advanced angle outer peripheral groove 31, the retarded angle outer peripheral groove 32, and the lock outer peripheral groove 96 to any of the advanced angle outer peripheral groove 31, the retarded angle outer peripheral groove 32, and the lock outer peripheral groove 96. The advanced angle outer peripheral groove 31 is constantly connected to the advanced angle chamber connection bore 17. The retarded angle outer peripheral groove 32 is constantly connected to the retarded angle chamber connection bore 18. Details of the lock outer peripheral groove 96 will be explained later.

Figure 5:
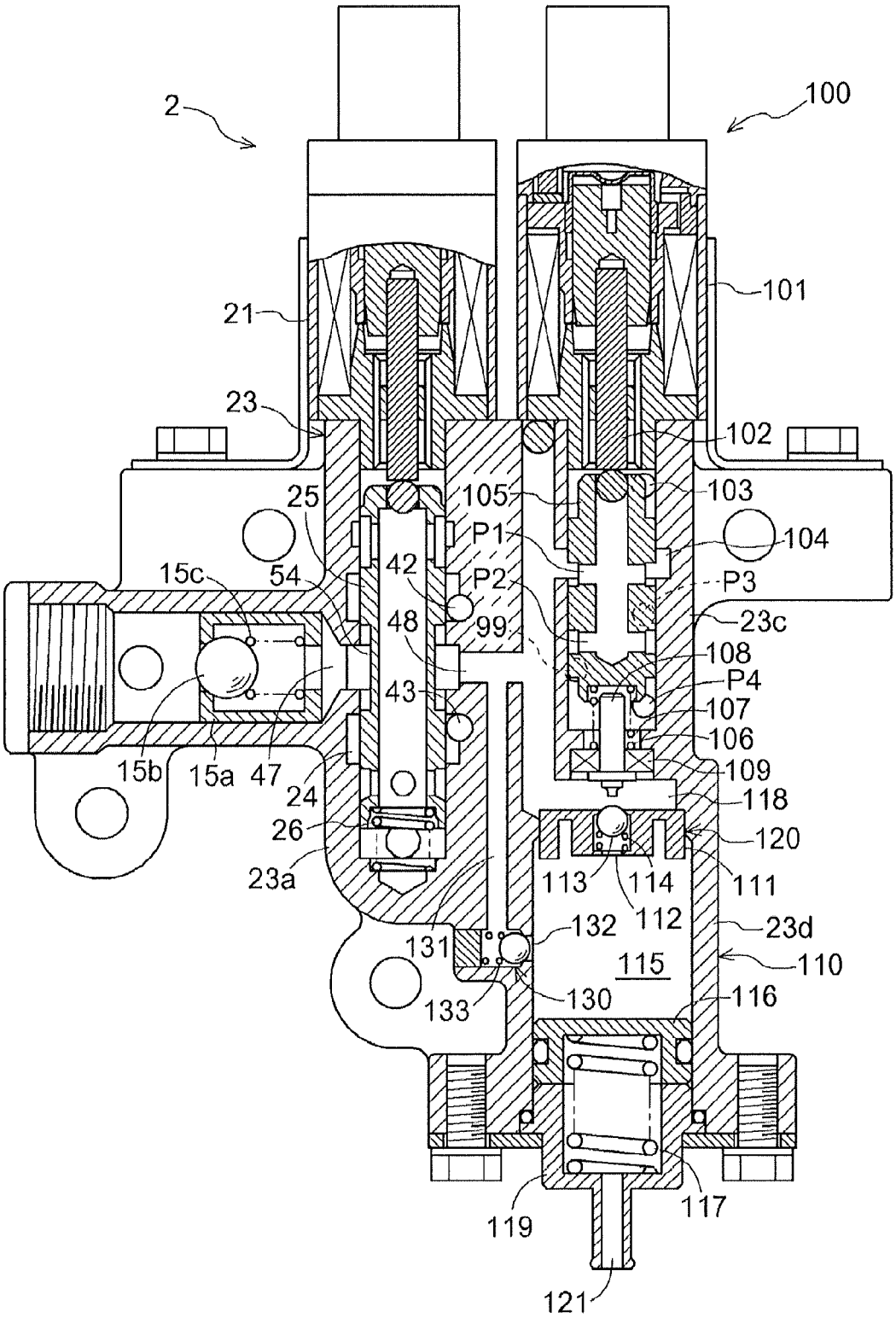
FIG. 5 is a cross-sectional view taken along line V-V in FIGS. 1 and 2.

As illustrated in FIGS. 1 and 5, a first supply flow passage 47 serving as a supply flow passage is formed in a direction perpendicular to axial directions of both the first spool accommodating portion 23*a* and the protruding portion 23*b*. A first end of the first supply flow passage 47 is connected to the hollow portion 24 of the first spool accommodating portion 23*a*. The hydraulic oil is supplied from a second end of the first supply flow passage 47 by the pump P. A sleeve 15*a* is provided at a portion of the first supply flow passage 47 in a state where a spherical valve member 15*b* is arranged within a void defined in the sleeve 15*a*. A spring 15*c* is disposed between the spherical valve member 15*b* and a portion of the sleeve 15*a* at a downstream side in the first supply flow passage 47*a* so as to bias the spherical valve member 15*b* towards a portion of the sleeve 15*a* at an upstream side in the first supply flow passage 47*a*. As a result, the hydraulic oil within the first supply flow passage 47 is inhibited from flowing backwards to the pump P.

An advanced angle flow passage 42 and a retarded angle flow passage 43 are formed at an inside of the protruding portion 23*b* in the extending direction of the protruding portion 23*b*, i.e., in the extending direction of the camshaft 8. A first end of the advanced angle flow passage 42 is connected to the hollow portion 24 while a second end of the advanced angle flow passage 42 is connected to the advanced angle outer peripheral groove 31. The advanced angle flow passage 42 constitutes a portion of the advanced angle outer peripheral groove 31. A first end of the retarded angle flow passage 43 is connected to the hollow portion 24 while a second end of the retarded angle flow passage 43 is connected to the retarded angle outer peripheral groove 32. The retarded angle flow passage 43 constitutes a portion of the retarded angle outer peripheral groove 32.

As illustrated in FIGS. 1 and 5, outer peripheral grooves for discharge 53*a*, 53*b*, which will be hereinafter referred to as discharge outer peripheral grooves 53*a*, 53*b*, and an outer peripheral groove for supply 54, which will be hereinafter referred to as a supply outer peripheral groove 54, each in annular form, are formed at an outer peripheral surface of the spool 25 over an entire periphery thereof. Through-holes 55*a* and 55*b* are formed at the discharge outer peripheral grooves 53*a* and 53*b*, respectively, so as to connect between the inside of the spool 25 to the hollow portion 24.

Positional relations between the discharge outer peripheral grooves 53*a*, 53*b* and the supply outer peripheral groove 54 are as follows. In a case where the solenoid 21 is not powered, the first supply flow passage 47 is connected to the advanced angle flow passage 42 by the supply outer peripheral groove 54 as illustrated in FIG. 1. In addition, the discharge outer peripheral groove 53*b* is connected to the retarded angle flow passage 43 as illustrated in FIG. 1. On the other hand, in a case where the solenoid 21 is powered, the first supply flow passage 47 is connected to the retarded angle flow passage 43 by the supply outer peripheral groove 54. In addition, the discharge outer peripheral groove 53*a* is connected to the advanced angle flow passage 42.

An intermediate lock mechanism 9 is provided between the outer rotor 3 and the inner rotor 5 for switching between a locked state in which the relative rotation of the outer rotor 3 and the inner rotor 5 is locked at an intermediate position between a most retarded angle position and a most advanced angle position and a lock released state in which the locked state of the relative rotation is released. As illustrated in FIG. 4, the relative rotation phase is locked at an intermediate lock phase between the most advanced angle phase and the most retarded angle phase by the intermediate lock mechanism 9.

The intermediate lock mechanism 9 includes lock member accommodating portions 91*a*, 91*b*, lock members 92*a*, 92*b*, a lock member recess portion 93 which will be hereinafter referred to as a lock recess portion 93, and springs 94*a*, 94*b* as illustrated in FIGS. 3 and 4. The lock member accommodating portions 91*a* and 91*b* are formed at the outer rotor 3. The lock recess portion 93 is formed at the inner rotor 5. In the locked state of the relative rotation of the outer rotor 3 and the inner rotor 5, the lock members 92*a* and 92*b* project into the lock recess portion 93 so that the relative rotation is restricted. In the lock released state of the relative rotation, the lock members 92*a* and 92*b* are retracted from the lock recess portion 93 to the lock member accommodating portions 91*a* and 91*b* respectively so that the relative rotation is permitted. The lock members 92*a* and 92*b* are constantly biased to project towards the lock recess portion 93 by the springs 94*a* and 94*b* arranged at the lock member accommodating portions 91*a* and 91*b* respectively.

As illustrated in FIGS. 2 and 5, the housing 23 includes a lock control valve portion 100 in addition to the fluid control valve portion 2. The lock control valve portion 100 controls supply and discharge of hydraulic oil flowing through an intermediate lock flow passage 99 of the intermediate lock mechanism 9. The lock control valve portion 100 includes a solenoid 101, a rod 102, the housing 23, a spool 105, and a spring 106. The spool 105 is in cylindrical form including a bottom. The housing 23 includes a second spool accommodating portion 23*c* accommodating the spool 105 and an accumulator accommodating portion 23*d* accommodating an accumulator 110 which will be explained later. A hollow portion 104 is formed at the second spool accommodating portion 23*c* for accommodating the spool 105. The hollow portion 104 is in cylindrical form including a bottom and opening at one side. The spool 105 is linearly movable along an axial direction of the hollow portion 104.

A connection portion 107 serving as a through-hole towards the accumulator 110 is formed at a bottom surface of the hollow portion 104. A pressing member 108 is arranged at the connection portion 107 for opening the accumulator 110. A bearing member 109 is provided at an outer periphery of the pressing member 108 so that the pressing member 108 is smoothly movable along an axial direction thereof. The spring 106 is arranged between the spool 105 and the bearing member 109. The spool 105 is biased towards the solenoid 101 by the spring 106. The pressing member 108 is held by the spring 106. In a state where the solenoid 101 is not powered, the pressing member 108 is held at a position away from an end portion of the spool 105.

The solenoid 101 is arranged at an end portion of the second spool accommodating portion 23*c* at the open side so as to reciprocate the spool 105. The rod 102 provided at an end portion of the solenoid 101 is in contact with a bottom portion of the spool 105. In a case where the solenoid 101 is powered, the rod 102 projects from the solenoid 101 to press the bottom portion of the spool 105. The spool 105 then moves in a direction away from the solenoid 101, i.e., in a downward direction in FIG. 2. In a case where the power supply to the solenoid 101 is stopped, the rod 102 is retracted towards the solenoid 101. The spool 105 moves in a direction towards the solenoid 101 i.e., in an upward direction in FIG. 2, so as to follow the movement of the rod 102 by the biasing force of the spring 106. A through-hole 103 is formed at the open side of the second spool accommodating portion 23*c* for realizing the reciprocating operation of the spool 105 at a high speed by connecting to the outside to flow air. The through-hole 103 may discharge leaking hydraulic oil to the outside.

As illustrated in FIGS. 1, 2, and 5, the housing 23 includes the second spool accommodating portion 23*c* accommodating the spool 105 of the lock control valve portion 100 and the accumulator accommodating portion 23*d* accommodating the accumulator 110, in addition to the first spool accommodating portion 23*a* accommodating the spool 25 and the protruding portion 23*b* inserted into the recess portion 14. The second spool accommodating portion 23*c* is arranged side by side with the first spool accommodating portion 23*a* in a direction perpendicular to the extending direction of the protruding portion 23*b*, i.e., of the camshaft 8. As illustrated in FIG. 5, axes of the first spool accommodating portion 23*a* and the second spool accommodating portion 23*c* are both perpendicular to the extending direction of the protruding portion 23*b* and positioned substantially coplanar with each other.

As illustrated in FIG. 2, the lock outer peripheral groove 96 is constantly connected to a lock connection bore 95. The intermediate lock flow passage 99 is formed along the extending direction of the protruding portion 23*b*. A first end of the intermediate lock flow passage 99 is connected to the hollow portion 104 while a second end of the intermediate lock flow passage 99 is connected to the lock outer peripheral groove 96. The intermediate lock flow passage 99 constitutes a portion of the lock outer peripheral groove 96. In addition, as illustrated in FIG. 5, a second supply flow passage 48 serving as the supply flow passage is formed between the first supply flow passage 47 and the hollow portion 104.

As illustrated in FIGS. 2 and 5, the accumulator 110 is arranged at an opposite side from the spool 105 relative to the pressing member 108 of the lock control valve portion 100. The accumulator 110 is a cylindrical container including a fluid storage portion 115 at which the hydraulic oil supplied to the fluid control valve portion 2 at the start of the engine E is accumulated or stored in a pressurized state. An accumulator control valve portion 120 is mounted at an opening portion of the fluid storage portion 15 facing the pressing member 108. The solenoid 101 controls both the lock control valve portion 100 and the accumulator control valve portion 120. That is, in the valve timing control apparatus 1, the single solenoid 101 is used and shared for controlling the lock control valve portion 100 and for controlling the accumulator control valve portion 120.

The accumulator control valve portion 120 that functions as a check valve is configured to include a partition wall portion 111, a penetration bore 112 formed at the partition wall portion 111, a spherical valve member 113, and a spring 114. The center of the spherical valve member 113 is coaxially positioned with the axis of the pressing member 108. The spring 114 biases the spherical valve member 113 in a direction to be closed, i.e., in an upward direction in FIGS. 2 and 5. As a result, the hydraulic oil stored at the fluid storage portion 115 is inhibited from leaking through the penetration bore 112.

The accumulator 110 includes a movable wall portion 116 at an opening side of the fluid storage portion 115 opposite from the accumulator control valve portion 120. The movable wall portion 116 is tightly in contact with an inner peripheral surface of the fluid storage portion 115. The movable wall portion 116 moves in an axial direction of the accumulator 110 to change a capacity (volume) of the fluid storage portion 115. In addition, a spring 117 is provided to bias the movable wall portion 116 in a direction in which the capacity of the fluid storage portion 115 is reduced so as to pressurize the hydraulic oil within the fluid storage portion 115. Further, an 0-ring is attached to an outer peripheral surface of the movable wall portion 116 to inhibit the hydraulic oil from leaking from the fluid storage portion 115.

A stopper 119 is attached to an axially outer side of the movable wall portion 116. The stopper 119 is in cylindrical form including a bottom. The movable wall portion 116 is in contact with an upper surface of the stopper 119 at an open side thereof so as to inhibit the movable wall portion 116 from moving in the axial direction. The capacity of the fluid storage portion 115 is at maximum in a state where the movable wall portion 116 makes contact with the stopper 119. The spring 117 is accommodated in an inner void of the stopper 119. A bottom surface of the stopper 119 supports one end of the spring 117 so that the spring 117 applies a biasing force to the movable wall portion 116. A back pressure bore 121 is formed at a center of the bottom surface of the stopper 119. In a case where the movable wall portion 116 moves, air flows through the back pressure bore 121 so as to release a back-pressure generated by the movement of the movable wall portion 116.

As illustrated in FIG. 5, a relief control valve portion 130 is provided at the accumulator 110, specifically, is positioned within the accumulator accommodating portion 23*d* at a radially outer side of an inner peripheral surface of the fluid storage portion 115. The relief control valve portion 130 includes a circulating flow passage 131 formed from the inner peripheral surface of the fluid storage portion 115 to the second supply flow passage 48, a spherical valve member 132, and a spring 133. The spring 133 biases the spherical valve member 132 in a direction to be closed, i.e., in a rightward direction in FIG. 5. Thus, the hydraulic oil stored at the fluid storage portion 115 is inhibited from flowing out through the relief control valve portion 130 to the circulating flow passage 131 in a case where an oil pressure of the hydraulic oil stored at the fluid storage portion 115 is equal to or smaller than a predetermined pressure. In a case where the oil pressure of the hydraulic oil stored at the fluid storage portion 115 exceeds the predetermined pressure, the spherical valve member 132 moves in a direction to be opened, i.e., in a leftward direction in FIG. 5, against a biasing force of the spring 133. The relief control valve portion 130 is thus opened to flow out the hydraulic oil to the circulating flow passage 131. When the oil pressure decreases to or below the predetermined pressure, the relief control valve portion 130 is closed by the biasing force of the spring 133.

Next, operations of the lock control valve portion 100 and the accumulator 110 will be explained with reference to FIGS. 6A, 6B, and 6C.

Figure 6A:
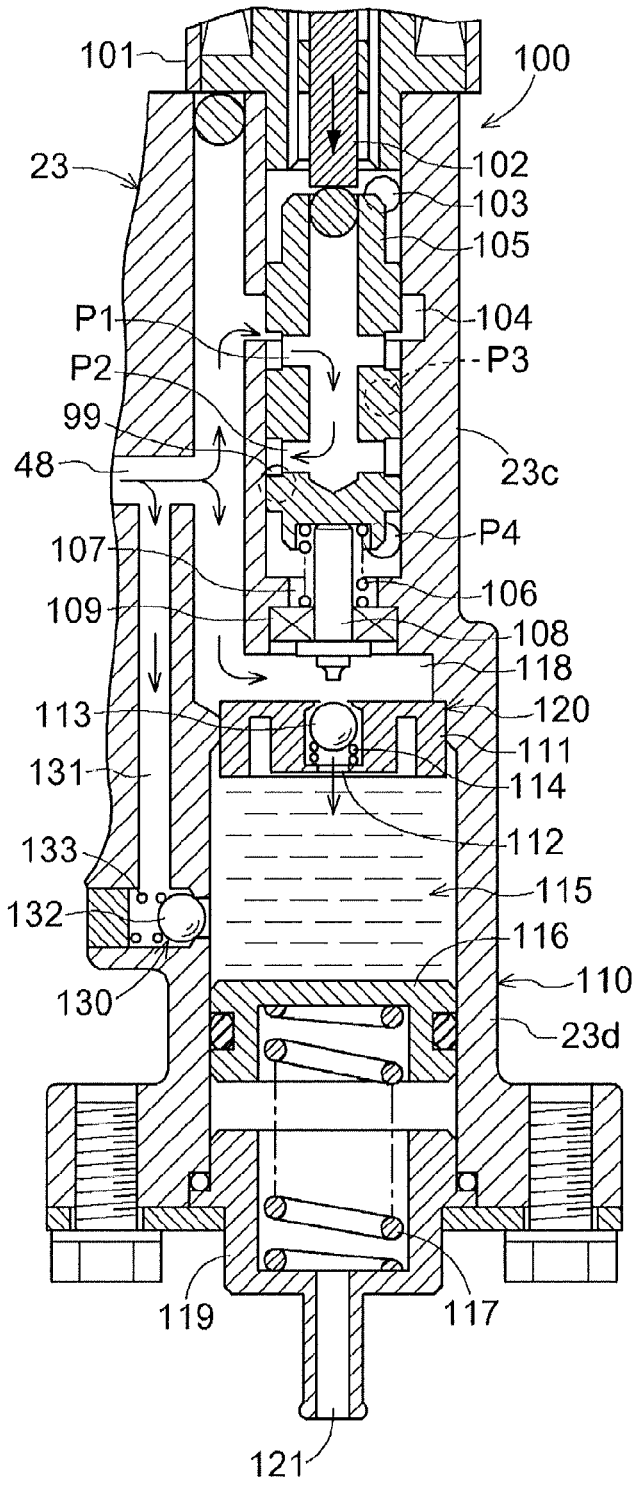
FIG. 6A is an enlarged cross-sectional view illustrating operations of the lock control valve portion and an accumulator in a case where an engine is operating.
Figure 6B:
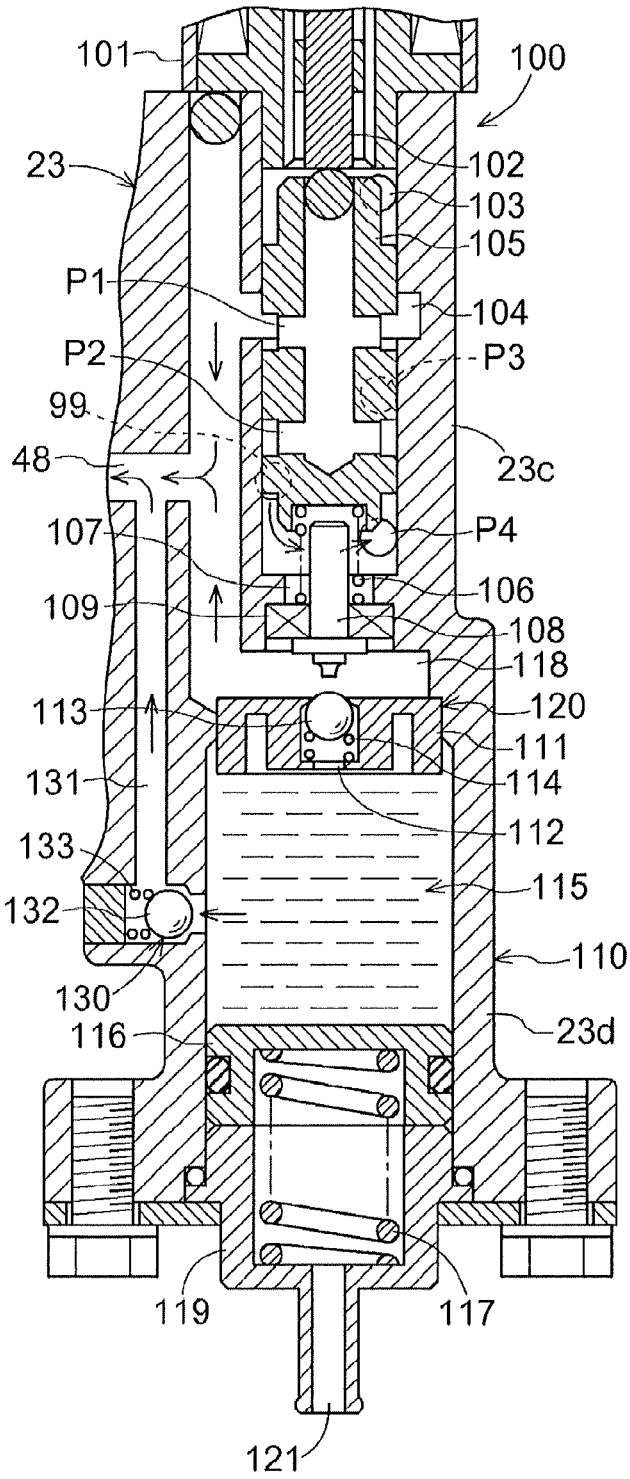
FIG. 6B is an enlarged cross-sectional view illustrating operations of the lock control valve portion and the accumulator in a case where the engine is stopped.
Figure 6C:
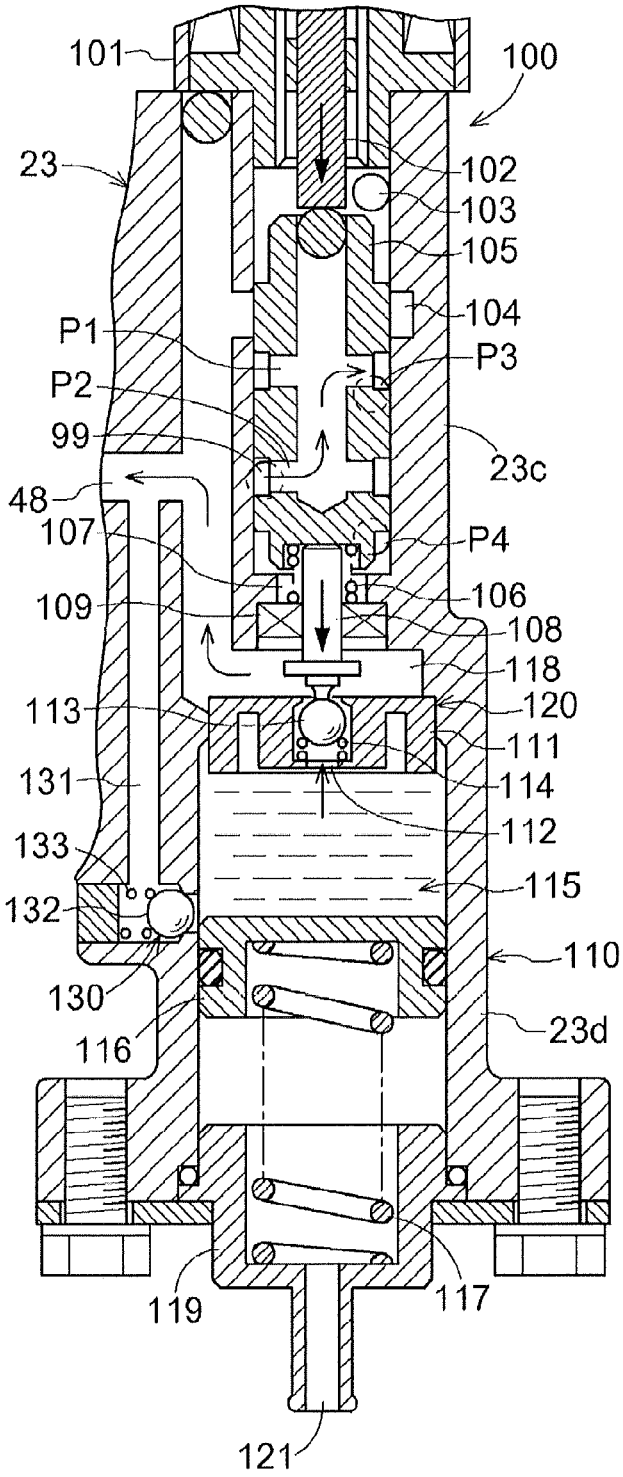
FIG. 6C is an enlarged cross-sectional view illustrating operations of the lock control valve portion and the accumulator in a case where the engine is started.

The lock control valve portion 100 is configured so that the spool 105 is switchable among a duty position as illustrated in FIG. 6A, an intermediate lock position as illustrated in FIG. 6B, and an accumulator operating position as illustrated in FIG. 6C. In the duty position, the hydraulic oil is supplied to the intermediate lock flow passage 99 to obtain the lock released state. In the intermediate lock position, the hydraulic oil is discharged from the intermediate lock flow passage 99 to obtain the locked state. In the accumulator operating position, the accumulator 110 is operated to open.

FIG. 6A illustrates the position, i.e., the duty position, of the spool 105 of the lock control valve portion 100 during a normal operation of the engine E. In this case, the solenoid 101 is moderately supplied with electric power and the spool 105 is positioned closer to the accumulator 110 as compared to the position illustrated in FIG. 6B. An outflow port P2 and the intermediate lock flow passage 99 are connected to each other. Because of a discharge pressure (for example, 500 kPa) of the pump P which is operating at this time, the hydraulic oil flows from the first supply flow passage 47 to the second supply flow passage 48. The hydraulic oil flowing to an inflow port P1 from the second supply flow passage 48 is supplied to the intermediate lock flow passage 99 via the outflow port P2. On the other hand, because the intermediate lock flow passage 99 is disconnected from drain bores P3, and P4, the hydraulic oil flowing to the inflow port P1 flows through the intermediate lock flow passage 99 to be supplied to the lock recess portion 93 to thereby retract the lock members 92*a* and 92*b* from the lock recess portion 93. As a result, the locked state of the relative rotation phase is released to obtain the lock released state.

The second supply flow passage 48 is connected to a supply flow passage 118 for supplying the hydraulic oil to the accumulator control valve portion 120 of the accumulator 110. In a case where the pressure of hydraulic oil supplied to the supply flow passage 118, i.e., the discharge pressure of the pump P, exceeds the biasing force of the spring 114, the spherical valve member 113 moves downward in FIG. 6A to thereby open the accumulator control valve portion 120. Then, the hydraulic oil is started to be supplied to the fluid storage portion 115. Before the hydraulic oil is supplied to the fluid storage portion 115, the movable wall portion 116 is positioned upward in FIG. 6A by the biasing force of the spring 117. That is, the capacity of the fluid storage portion 115 is at minimum. At this time, however, because the hydraulic oil is kept supplied to the supply flow passage 118 even when the fluid storage portion 115 is filled up, the accumulator control valve portion 120 is kept opened. Thus, in a case where the pressure of the hydraulic oil exceeds the biasing force of the spring 117, the movable wall portion 116 moves downward in FIG. 6A to thereby increase the capacity of the fluid storage portion 115. The hydraulic oil is further supplied to the fluid storage portion 115 accordingly. Eventually, the fluid storage portion 115 is filled with the hydraulic oil in a state where the movable wall portion 116 is in contact with the stopper 119. The hydraulic oil within the fluid storage portion 115 is accumulated against the biasing force of the spring 117 and is pressurized. In the aforementioned eventual state, as long as the pump P is operating, the accumulator control valve portion 120 is maintained to be opened.

The oil pressure obtained by the hydraulic oil accumulated at the fluid storage portion 115 is defined as a holding oil pressure. In addition, an upper limit holding oil pressure at which the accumulator control valve portion 120 is opened by the downward movement of the spherical valve member 113 by the pressing member 108 is defined as a limit holding oil pressure serving as a predetermined value. According to the present embodiment, the upper limit holding oil pressure is specified to be 300 kPa. Specifically, the pressure applied to the spherical valve member 113 by the pressing member 108 when a maximum electric power is supplied to the solenoid 101 is 300 kPa. The relief control valve portion 130 is operated to open when the holding oil pressure exceeds 300 kPa and to close by releasing the hydraulic oil until the holding oil pressure becomes equal to or smaller than 300 kPa. That is, it is necessary to specify the pressure at which the relief control valve portion 130 is opened is equal to or smaller than the maximum pressure that may be generated by the solenoid 101.

According to the present embodiment, the discharge pressure of the pump P is 500 kPa. Thus, the relief control valve portion 130 is supposed to be opened to release the hydraulic oil at a time when the holding oil pressure exceeds 300 kPa in ordinary circumstances so that the holding oil pressure within the fluid storage portion 115 is maintained at 300 kPa or below 300 kPa. Nevertheless, in the process of supply of the hydraulic oil to the fluid storage portion 115, the hydraulic oil having the pressure of 500 kPa as being supplied to the supply flow passage 118 also flows to the circulating flow passage 131. As a result, the pressure of 500 kPa is also applied to the spherical valve member 132. Thus, even when the hydraulic oil including the pressure exceeding 300 kPa serving as the limit holding oil pressure flows to the fluid storage portion 115, the relief control valve portion 130 is inhibited from opening. The hydraulic oil including the holding oil pressure of 500 kPa is accumulated at the accumulator 110 accordingly.

The state of the spool 105 of the lock control valve portion 100 when the engine E is stopped by turning-off of an ignition as illustrated in FIG. 6B corresponds to the locked state of the relative rotation phase at the intermediate lock phase as illustrated in FIG. 4. At this time, the solenoid 101 is not powered and the position of the spool 105, i.e., the intermediate lock position, is closest to the solenoid 101. The pump P is stopped so that the hydraulic oil is inhibited from further being supplied. A portion of the hydraulic oil that has been already supplied from the pump P and thus that remains at a portion from the first supply flow passage 47 to the second supply flow passage 48 flows from the inflow port P1 to the spool 105. Nevertheless, the outflow port P2 is disconnected from the intermediate lock flow passage 99 so that the hydraulic oil is inhibited from being supplied to the intermediate lock flow passage 99. On the other hand, the intermediate lock flow passage 99 is connected to the drain bore P4 so that the hydraulic oil that remains at the intermediate lock flow passage 99 is discharged through the drain bore P4 to be collected at or recovered to an oil pan. Consequently, the hydraulic oil is inhibited from being supplied to the lock recess portion 93 so that the relative rotation phase is brought in the locked state in which the relative rotation phase is locked at the intermediate phase between the most retarded angle phase and the most advanced angle phase.

Because the pump P is stopped, the oil pressure is not generated at the hydraulic oil from the first supply flow passage 47 to the second supply flow passage 48. A large portion of such hydraulic oil is recovered to the oil pan. Because the oil pressure is also not generated at the hydraulic oil that remains at the supply flow passage 118, the spherical valve member 113 moves upward by the biasing force of the spring 114 to thereby close the accumulator control valve portion 120.

Once the pump P is stopped, the hydraulic oil that remains at the circulating flow passage 131 is not pressurized. Thus, the pressure of hydraulic oil in the circulating flow passage 131 is inhibited from being applied to the spherical valve member 132. The relief control valve portion 130 may be opened accordingly. Because the hydraulic oil accumulated at the fluid storage portion 115 of the accumulator 110 includes the holding oil pressure of 500 kPa, the spherical valve member 132 moves leftward in FIG. 6B so that the relief control valve portion 130 is opened. A portion of the hydraulic oil within the fluid storage portion 115 is released to the circulating flow passage 131 to decrease the holding oil pressure within the fluid storage portion 115. The hydraulic oil released to the circulating flow passage 131 is recovered to the oil pan by flowing through the aforementioned passage. In a case where the holding oil pressure decreases to 300 kPa serving as the limit holding oil pressure, the biasing force of the spring 133 exceeds the holding oil pressure and thus the spherical valve member 132 moves rightward in FIG. 6B, thereby closing the relief control valve portion 130. As a result, the hydraulic oil including the pressure equal to or smaller than the limit holding oil pressure is stored at the fluid storage portion 115.

FIG. 6C illustrates the position, i.e., the accumulator operating position, of the spool 105 of the lock control valve portion 100 in a case where the engine E is started by turning-on of the ignition. In this case, the solenoid 101 is maximally supplied with electric power and the spool 105 is positioned further closer to the accumulator 110 as compared to the position illustrated in FIG. 6A. At this time, the hydraulic oil pressure within the fluid storage portion 115 is equal to or smaller than the limit holding oil pressure. Thus, the pressing member 108 attached to the end portion of the spool 105 presses down the spherical valve member 113 serving as the check valve to thereby open the accumulator control valve portion 120. That is, the fluid storage portion 115 and the supply flow passage 118 are connected to each other via the penetration bore 112 so that the hydraulic oil accumulated at the fluid storage portion 115 is released to the supply flow passage 118.

Immediately after the start of the engine E, the hydraulic oil is not supplied from the first supply flow passage 47 to the supply flow passage 118 supplying the hydraulic oil to the accumulator 110 via the second supply flow passage 48. Thus, in a case where the accumulator control valve portion 120 is opened, the hydraulic oil released from the fluid storage portion 115 to the supply flow passage 118 is supplied to the fluid control valve portion 2 via the second supply flow passage 48. At this time, the spool 25 is at a position at which the hydraulic oil is supplied to the advanced angle chambers 6*a*. The spool 105 at the lock control valve portion 100 is at a position at which the hydraulic oil is inhibited from flowing to the inflow port P1 from the second supply flow passage 48.

The intermediate lock mechanism 9 is configured to be brought to the locked state because the intermediate lock flow passage 99 is switched to a drained state once the position of the spool 105 of the lock control valve portion 100 is changed to the accumulator operating position. That is, in a case where the spool 105 of the lock control valve portion 100 is in the accumulator operating position, the intermediate lock flow passage 99 is connected to the drain bore P3 so that the hydraulic oil is discharged through the drain bore P3. Accordingly, once the position of the spool 105 of the lock control valve portion 100 is changed to the accumulator operating position, the hydraulic oil is discharged from the intermediate lock flow passage 99 so that the lock members 92*a* and 92*b* of the intermediate lock mechanism 9 may easily enter the lock recess portion 93. In addition, the hydraulic oil released from the accumulator 110 is supplied to the advanced angle chambers 6*a* from the fluid control valve portion 2 so as to securely operate the intermediate lock mechanism 9 at the start of the engine E. The startability of the engine E is enhanced accordingly.

Thereafter, the position of the spool 105 of the lock control valve portion 100 is switched to the duty position as illustrated in FIG. 6A so that the hydraulic oil released from the accumulator 110 is also supplied to the intermediate lock flow passage 99. As a result, even at the time of the start of the engine E, the hydraulic oil stored at the accumulator 110 is used to achieve prompt advanced angle control and retarded angle control by the fluid control valve portion 2.

According to the aforementioned embodiment, even in a case where the limit holding oil pressure at the accumulator 110 (i.e., 300 kPa) is smaller than the pressure of hydraulic oil discharged from the pump P (i.e., 500 kPa), the hydraulic oil is released from the relief control valve portion 130 to decrease the oil pressure. As a result, before the start of the engine E, the hydraulic oil at the limit holding oil pressure or below the limit holding oil pressure is accumulated at the fluid storage portion 115. Performance of the pump P and performance of the accumulator 110 may be independently obtained, which leads to a design flexibility.

According to the aforementioned embodiment, the pressure of hydraulic oil discharged from the pump P is specified to be 500 kPa while the limit holding oil pressure is specified to be 300 kPa. Nevertheless, the aforementioned pressures are not limited to such values and appropriate pressure values may be specified depending on design specifications. For example, the pressure of hydraulic oil discharged from the pump P and the limit holding oil pressure may be both 300 kPa. At this time, however, the hydraulic oil including the holding oil pressure greater than 300 kPa may be accumulated at the fluid storage portion 115 because of an unexpected pulsation, for example. Nevertheless, because the accumulator 110 includes the relief control valve portion 130, the hydraulic oil accumulated at the fluid storage portion 115 may be maintained at the limit holding oil pressure or below the limit holding oil pressure against an unexpected pulsation, for example. The accumulator control valve portion 120 may be securely opened by the pressing member 108.

According to the aforementioned embodiment, the circulating flow passage 131 is formed to connect to the second supply flow passage 48. Alternatively, the circulating flow passage 131 may be directly connected to the fluid control valve portion 2 or connected to the first supply flow passage 47.

In addition, according to the aforementioned embodiment, the accumulator control valve portion 120 is opened by the usage of the lock control valve portion 100. Alternatively, the accumulator control valve portion 120 may be operated by a solenoid different from the lock control valve portion 100.

Further, according to the aforementioned embodiment, the accumulator 110 (the fluid storage portion 115) is arranged on an extension in the reciprocating direction of the spool 105 of the lock control valve portion 100. Alternatively, the accumulator 110 may be arranged at a position except for on the extension in the reciprocating direction of the spool 105 of the lock control valve portion 100.

Next, an operation of the valve timing control apparatus 1 according to the first embodiment will be explained with reference to the attached drawings.

As illustrated in FIG. 1, in a case where the hydraulic oil is supplied to the advanced angle chambers 6*a* so as to displace the relative rotation phase in the advanced angle direction S1, the electric power is not supplied to the solenoid 21 of the fluid control valve portion 2. At this time, the spool 25, together with the rod 22 of the solenoid 21, moves towards the solenoid 21 by the biasing force of the spring 26. When the hydraulic oil is supplied from the pump P to the first supply flow passage 47 in a state where the electric power is not supplied to the solenoid 21, the hydraulic oil is supplied from the first supply flow passage 47 to flow through the supply outer peripheral groove 54, the advanced angle flow passage 42, the advanced angle outer peripheral groove 31, and the advanced angle chamber connection bore 17 and is sent by pressurized to each of the advanced angle chambers 6*a*. At this time, each of the vanes 7 relatively rotates in the advanced angle direction S1 so that the hydraulic oil in each of the retarded angle chambers 6*b* is discharged. The hydraulic oil discharged from each of the retarded angle chambers 6*b* flows through the retarded angle chamber connection bore 18, the retarded angle outer peripheral groove 32, the retarded angle flow passage 43, the discharge outer peripheral groove 53*b*, the through-hole 55*b*, and a drain flow passage so as to be discharged to the outside of the valve timing control apparatus 1 to be recovered to the oil pan.

On the other hand, in a case where the hydraulic oil is supplied to the retarded angle chambers 6*b* to displace the relative rotation phase in the retarded angle direction S2, the electric power is supplied to the solenoid 21 of the fluid control valve portion 2. At this time, the spool 25 is pushed by the rod 22 of the solenoid 21 to move downward in FIG. 1. When the hydraulic oil is supplied from the pump P to the first supply flow passage 47 in a state where the electric power is supplied to the solenoid 21, the hydraulic oil is supplied from the first supply flow passage 47 to flow through the supply outer peripheral groove 54, the retarded angle flow passage 43, the retarded angle outer peripheral groove 32, and the retarded angle chamber connection bore 18 and is sent by pressurized to each of the retarded angle chambers 6*b*. At this time, each of the vanes 7 relatively rotates in the retarded angle direction S2 so that the hydraulic oil in each of the advanced angle chambers 6*a* is discharged. The hydraulic oil discharged from each of the advanced angle chambers 6*a* flows through the advanced angle chamber connection bore 17, the advanced angle outer peripheral groove 31, the advanced angle flow passage 42, the discharge outer peripheral groove 53*a*, the through-hole 55*a*, and a drain flow passage so as to be discharged to the outside of the valve timing control apparatus 1 to be recovered to the oil pan.

As mentioned above, the fluid control valve portion 2, the lock control valve portion 100, and the accumulator control valve portion 120 are provided at an opposite side of the camshaft 8 relative to the outer rotor 3 or the inner rotor 5. Thus, the hydraulic oil is securely supplied to the fluid control valve portion 2 from the accumulator 110 at the start of the internal combustion engine (i.e., the engine E). Thus, valve opening and closing characteristics by the fluid control valve portion 2 may be obtained immediately after the start of the engine E. In addition, because the solenoid 101 is used to control the lock control valve portion 100 and to control the accumulator control valve portion 120, the valve timing control apparatus 1 may be downsized, i.e., compactly configured.

The spool 105 is switchable between the locked state in which the hydraulic oil is discharged from the intermediate lock flow passage 99 and the lock released state in which the hydraulic oil is supplied to the intermediate lock flow passage 99 by the reciprocating operation of the spool 105 provided at the lock control valve portion 100. In addition, the accumulator control valve portion 120 may be opened. That is, the spool 105 of the lock control valve portion 100 is used for controlling both the lock control valve portion 100 and the accumulator control valve portion 120. A separate member for controlling the accumulator control valve portion 120 is not necessary. As a result, operation mechanisms of the lock control valve portion 100 and the accumulator control valve portion 120 are simplified. The operations of the lock control valve portion 100 and the accumulator control valve portion 120 may be also simplified.

According to the aforementioned embodiment, as illustrated in FIG. 4, the two lock members 92*a* and 92*b* project into the single lock recess portion 93 so as to obtain the locked state. Alternatively, for example, the single lock member is provided relative to the single lock recess portion 93. In this case, a width of the lock recess portion 93 in the circumferential direction may be specified to be substantially the same as a width of the lock member in the circumferential direction.

Figure 7:
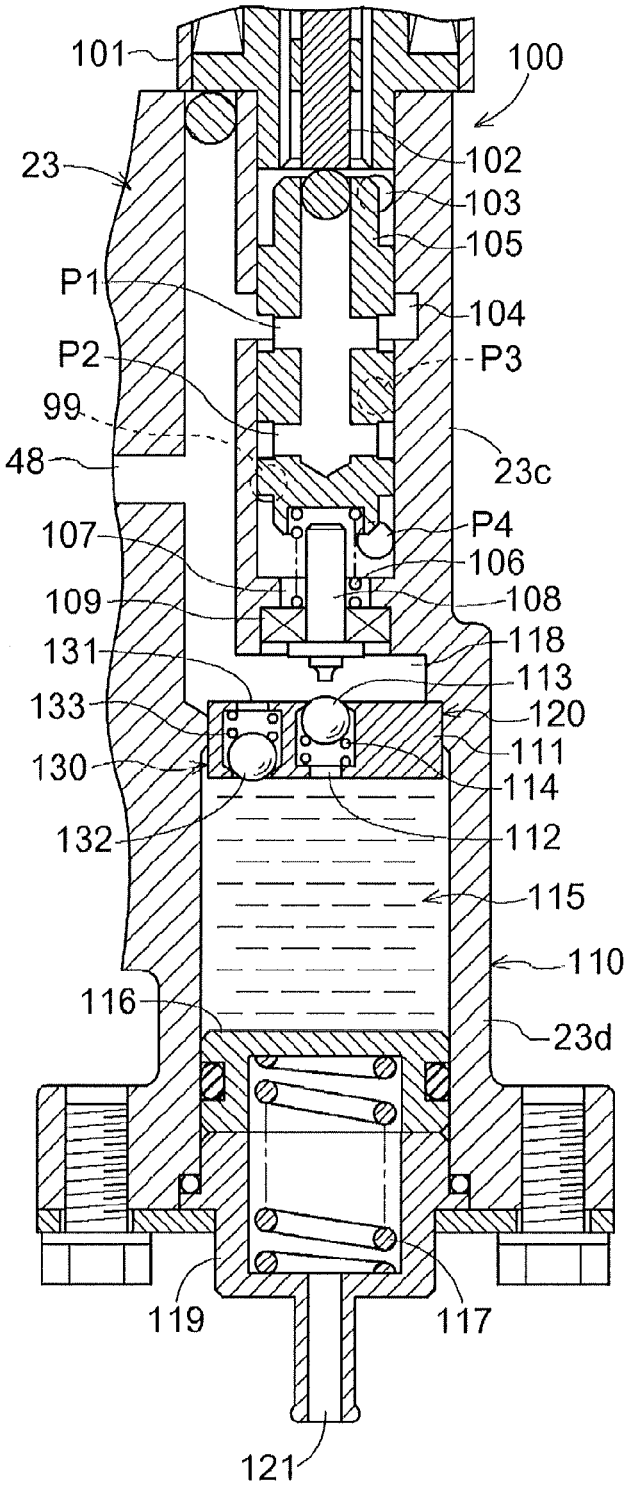
FIG. 7 is an enlarged cross-sectional view illustrating a configuration of a relief control valve portion of the valve timing control apparatus according to a second embodiment disclosed here.

A configuration of the relief control valve portion 130 of the valve timing control apparatus 1 according to a second embodiment will be explained with reference to FIG. 7. In the second embodiment, the same configurations of those of the first embodiment bear the same reference numerals and an explanation thereof will be omitted. According to the second embodiment, a portion at which the relief control valve portion 130 is provided is different from the first embodiment. The other configurations of the second embodiment are the same as the first embodiment.

The relief control valve portion 130 of the valve timing control apparatus 1 according to the second embodiment is formed at the partition wall portion 111. As a result, as compared to the first embodiment in which the circulating flow passage 131, for example, is formed within the accumulator accommodating portion 23*d*, the circulating flow passage 131, for example, may be processed before the partition wall portion 111 is assembled on the accumulator 110, which results in an easy processing. In addition, as compared to the first embodiment, a length of the circulating flow passage 131 is small and the circulating flow passage 131 may be processed together with the penetration bore 112, which leads to a reduction in processing man-hours as a whole. The valve timing control apparatus 1 may be manufactured at a reduced cost.

A configuration of the relief control valve portion 130 of the valve timing control apparatus 1 according to a third embodiment will be explained with reference to FIG. 8. According to the third embodiment, a portion at which the relief control valve portion 130 is provided is different from the first and second embodiments. The other configurations of the third embodiment are the same as the first and second embodiments.

The relief control valve portion 130 of the valve timing control apparatus 1 according to the third embodiment is formed at the movable wall portion 116. The hydraulic oil released from the relief control valve portion 130 is not circulated to the second supply flow passage 48, for example, and is discharged to the outside of the valve timing control apparatus 1 to be recovered to the oil pan. According to the relief control valve portion 130 of the third embodiment, a release flow passage 134 corresponding to the circulating flow passage 131 according to the first and second embodiments is formed at a center of the movable wall portion 116. The spherical valve member 132 and the spring 133 are provided at an inside of the release flow passage 134.

Figure 8:
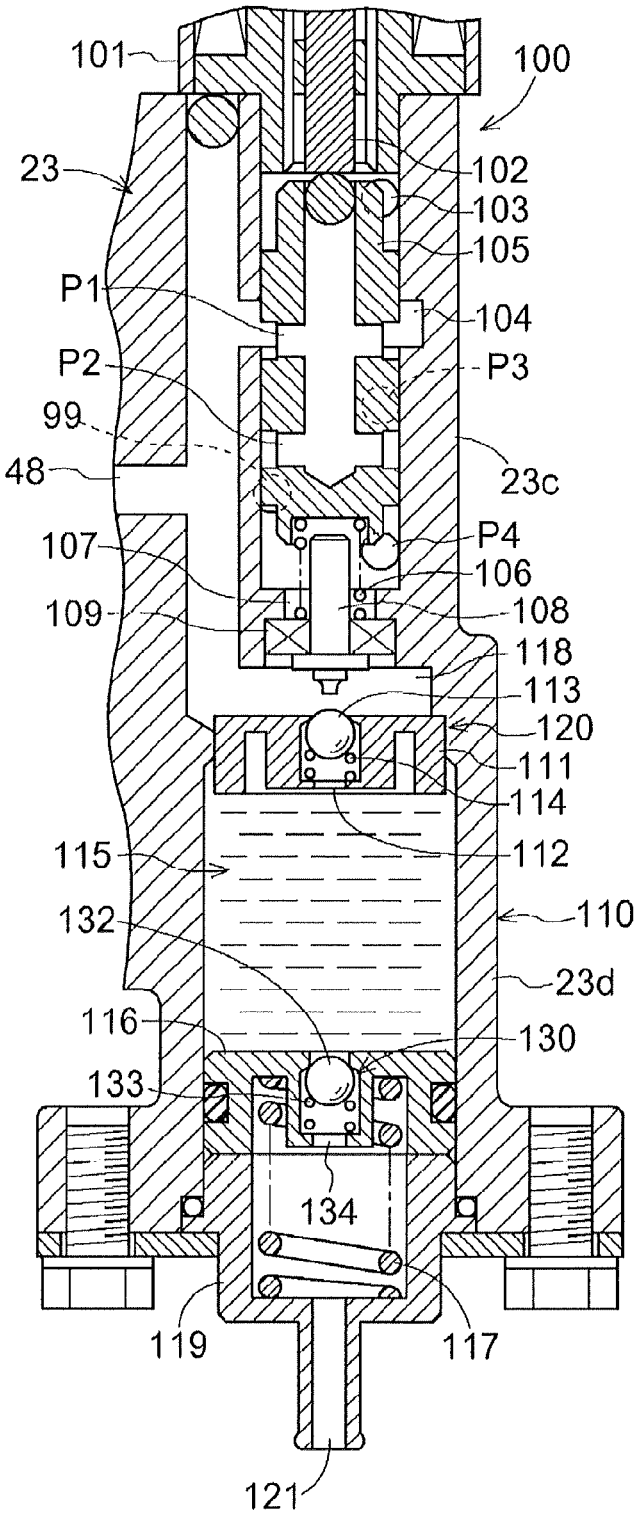
FIG. 8 is an enlarged cross-sectional view illustrating a configuration of the relief control valve portion of the valve timing control apparatus according to a third embodiment disclosed here.

As illustrated in FIG. 8, the relief control valve portion 130 is arranged at an inner void of the spring 117 so that an existing void is utilized. An additional void or space for accommodating the relief control valve portion 130 is not necessary. The hydraulic oil that is released is discharged to the outside through the back pressure bore 121 and therefore an additional flow passage is not necessary. As a result, an additional processing except for processing the movable wall portion 116 is not required. The existing valve timing control apparatus 1 is modified with a minimum design change so as to form the relief control valve portion 130.

According to the third embodiment, the hydraulic oil that is released is not circulated. Thus, the discharge pressure of the pump P is inhibited from being specified to exceed the limit holding oil pressure of the accumulator 110. For example, in a case where the hydraulic oil including the oil pressure exceeding 300 kPa serving the limit holding oil pressure flows to the fluid storage portion 115 while the engine E is operating, the relief control valve portion 130 is automatically opened to release the hydraulic oil to thereby decrease the holding oil pressure to or below 300 kPa. Thus, even when the discharge pressure of the pump P increases, the pressure exceeding the limit holding oil pressure is fully released from the relief control valve portion 130. The upper limit of oil pressure of the entire hydraulic oil supplied from the pump P is limited by the limit holding oil pressure. This is because the spherical valve member 132 of the relief control valve portion 130 does not receive a pressure of hydraulic oil discharged from the pump P. Therefore, according to the third embodiment, the discharge pressure of the pump P is necessarily specified to be equal to or smaller than the limit holding oil pressure of the accumulator 110. That is, in a case where it is acceptable that the discharge pressure of the pump P is equal to or smaller than the limit holding oil pressure of the accumulator 110, a minimum design change is applied to the existing valve timing control apparatus 1 so as to form the relief control valve portion 130. The hydraulic oil accumulated at the fluid storage portion 115 may be maintained at the limit holding oil pressure or below the limit holding oil pressure against an unexpected pulsation, for example. The accumulator control valve portion 120 is securely opened by the pressing member 108.

Figure 9:
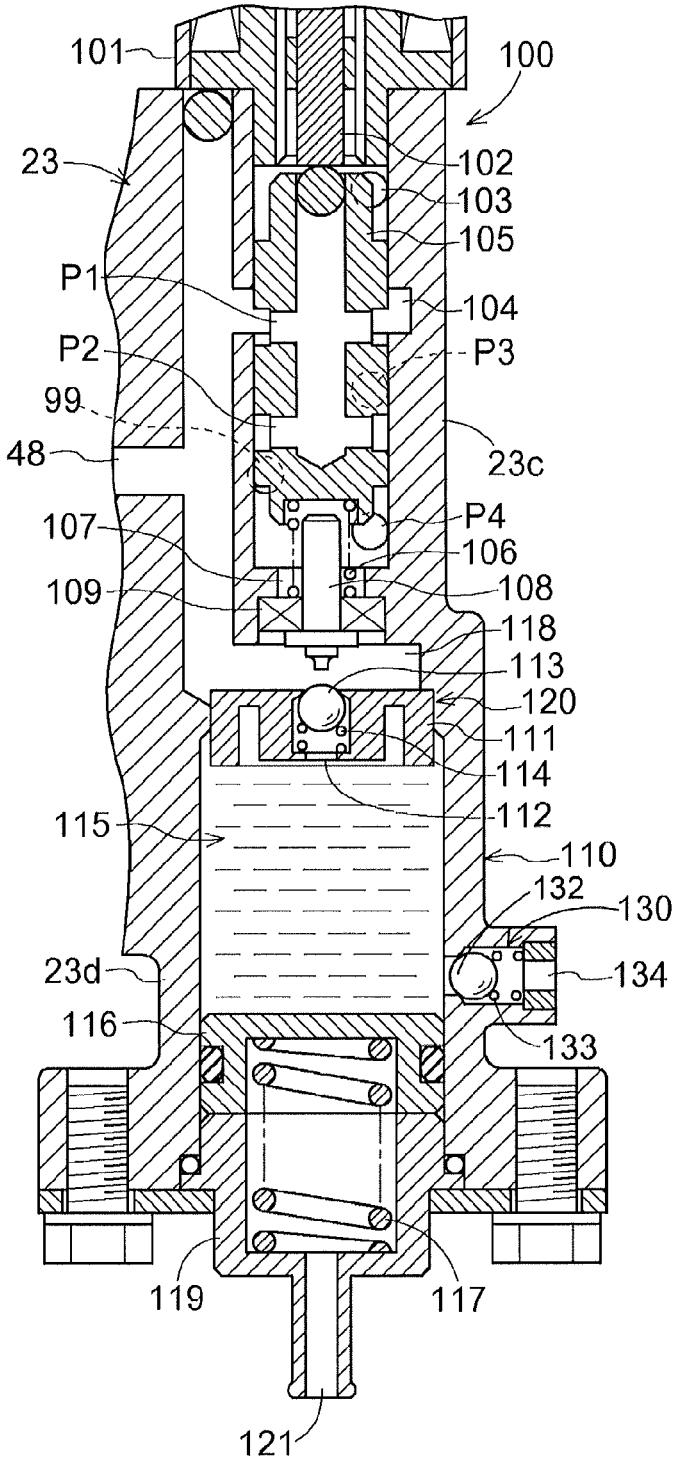
FIG. 9 is an enlarged cross-sectional view illustrating a configuration of the relief control valve portion of the valve timing control apparatus according to a fourth embodiment disclosed here.

A configuration of the relief control valve portion 130 of the valve timing control apparatus 1 according to a fourth embodiment will be explained with reference to FIG. 9. According to the fourth embodiment, a portion at which the relief control valve portion 130 is provided is different from the first, second, and third embodiments. The other configurations of the fourth embodiment are the same as the first to third embodiments.

The relief control valve portion 130 of the valve timing control apparatus 1 according to the fourth embodiment is provided at the accumulator accommodating portion 23*d*, which is the same as the first embodiment. Nevertheless, according to the fourth embodiment, the hydraulic oil discharged from the relief control valve portion 130 is not circulated and is discharged to the outside of the valve timing control apparatus 1 to be recovered to the oil pan. According to the relief control valve portion 130 of the third embodiment, the release flow passage 134 is formed at the accumulator accommodating portion 23*d*. The spherical valve member 132 and the spring 133 are provided at an inside of the release flow passage 134.

According to the fourth embodiment, the discharge pressure of the pump P may be equal to or smaller than the limit holding oil pressure, which may be effective for a case where a space or void at which the relief control valve portion 130 is formed is not available at the movable wall portion 116. Because of the relief control valve portion 130, the hydraulic oil accumulated at the fluid storage portion 115 may be maintained at the limit holding oil pressure or below the limit holding oil pressure against an unexpected pulsation, for example. The accumulator control valve portion 120 may be securely opened by the pressing member 108.

Each of the aforementioned embodiments is applicable to a valve timing control apparatus that controls a relative rotation phase of a driven-side rotation member relative to a driving-side rotation member that rotates in synchronization with a crankshaft of an internal combustion engine.

In the valve timing control apparatus 1, the pressure of the hydraulic oil greater than the oil pressure at which the accumulator control valve portion 120 (check valve) is opened by the solenoid 101 may be accumulated at the fluid storage portion 115 during the operation of the engine E because of an unexpected pulsation, for example. At this time, the oil pressure at which the accumulator control valve portion 120 may be opened by the solenoid 101 corresponds to the limit holding oil pressure, i.e., 300 kPa. Nevertheless, according to the aforementioned embodiments, the accumulator 110 includes the relief control valve portion 130 so that, even in a case where the pressure of the hydraulic oil greater than the limit holding oil pressure is accumulated at the fluid storage portion 115, the hydraulic oil is released via the relief control valve portion 130 to maintain the pressure of the hydraulic oil accumulated at the fluid storage portion 115 to be equal to or smaller than the limit holding oil pressure. As a result, the accumulator control valve portion 120 may be securely opened by the solenoid 101.

According to the aforementioned first and second embodiments, the valve timing control apparatus further includes the circulating flow passage 131 connecting the fluid storage portion 115 to one of the supply flow passage 47, 48, and the fluid control valve portion 2 via the relief control valve portion 130.

Accordingly, the discharge pressure of the pump P may be made greater than the limit holding oil pressure. Because the hydraulic oil discharged from the pump P flows through the circulating flow passage 131 to apply the discharge pressure of the pump P to the relief control valve portion 130 during the operation of the pump P, the relief control valve portion 130 is inhibited from opening even in a case where the pressure of the hydraulic oil greater than the limit holding oil pressure is accumulated at the fluid storage portion 115. After the operation of the pump P is stopped, the pressure of hydraulic oil within the circulating flow passage 131 decreases so that the relief control valve portion 130 is opened to release the hydraulic oil, which results in a decrease of oil pressure of the hydraulic oil accumulated at the fluid storage portion 115. As a result, before the start of the engine E, the pressure of the hydraulic oil accumulated at the fluid storage portion 115 is made equal to or smaller than the limit holding oil pressure. Because of the circulating flow passage 131, performance of the pump P and performance of the accumulator 110 may be independently obtained, which leads to a design flexibility.

In addition, according to the aforementioned third embodiment, the relief control valve portion 130 is provided at the movable wall portion 116 of the accumulator 130.

Accordingly, an additional space for accommodating the relief control valve portion 130 is not necessary. The relief control valve portion 130 may be provided only by an additional processing on the movable wall portion 116. In addition, the hydraulic oil released from the relief control valve portion 130 is discharged to the outside of the valve timing control apparatus 1 via the back pressure bore 121. Thus, an additional flow passage for releasing the hydraulic oil is not necessary. As a result, the relief control valve portion 130 may be provided at the existing valve timing control apparatus 1 with a minimum design change performed thereon. Because of the relief control valve portion 130, the hydraulic oil accumulated at the fluid storage portion 115 is made equal to or smaller than the limit holding oil pressure even when an unexpected pulsation, for example, occurs, thereby securely opening the accumulator control valve portion 120 by the solenoid 101.

Further, according to the aforementioned fourth embodiment, the relief control valve portion 130 is provided at the accumulator accommodating portion 23*d* within which the accumulator 110 is accommodated.

Accordingly, in a case of no space for providing the relief control valve portion 130 at the movable wall portion 116, the relief control valve portion 130 may be still provided. Because of the relief control valve portion 130, the hydraulic oil accumulated at the fluid storage portion 115 is made equal to or smaller than the limit holding oil pressure even when an unexpected pulsation, for example, occurs, thereby securely opening the accumulator control valve portion 120 by the solenoid 101.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving-side rotation member rotating in synchronization with a crankshaft of an internal combustion engine;

a driven-side rotation member arranged coaxial with the driving-side rotation member and rotating in synchronization with a camshaft for opening and closing a valve of the internal combustion engine;

a fluid chamber formed by the driving-side rotation member and the driven-side rotation member;

an advanced angle chamber and a retarded angle chamber formed by divided portions of the fluid chamber divided by a partition portion that is provided at at least one of the driving-side rotation member and the driven-side rotation member;

a fluid control valve portion controlling supply and discharge of fluid relative to each of the advanced angle chamber and the retarded angle chamber;

an accumulator accumulating a portion of fluid supplied to the fluid control valve portion from a pump at a fluid storage portion during an operation of the internal combustion engine and supplying fluid accumulated at the fluid storage portion to the fluid control valve portion at a start of the internal combustion engine; and a supply flow passage connecting the pump, the fluid control valve portion, and the accumulator in series to cause fluid to flow therethrough, the accumulator including a relief control valve portion that is configured to maintain a pressure of fluid accumulated at the fluid storage portion equal to or smaller than a predetermined value.

2. The valve timing control apparatus according to claim 1, further comprising a circulating flow passage connecting the fluid storage portion to one of the supply flow passage and the fluid control valve portion via the relief control valve portion.

3. The valve timing control apparatus according to claim 2, wherein the relief control valve portion is provided at an accumulator accommodating portion within which the accumulator is accommodated.

4. The valve timing control apparatus according to claim 1, wherein the relief control valve portion is provided at a movable wall portion of the accumulator.

5. The valve timing control apparatus according to claim 1, wherein the relief control valve portion is provided at an accumulator accommodating portion within which the accumulator is accommodated.

* * * * *